US008747047B2

(12) United States Patent
Sikora et al.

(10) Patent No.: US 8,747,047 B2
(45) Date of Patent: Jun. 10, 2014

(54) DEVICE FOR UNLOADING COMPARTMENT TRAYS, USED IN TOBACCO INDUSTRY, FILLED WITH ROD SHAPED ELEMENTS

(75) Inventors: Leszek Sikora, Radom (PL); Adam Gielniewski, Radom (PL); Radoslaw Owczarek, Radom (PL); Bartosz Cieslikowski, Przysucha (PL)

(73) Assignee: International Tobacco Machinery Poland SP. Z O.O., Radom (PL)

( * ) Notice: Subject to any disclaimer, the term of this patent is extended or adjusted under 35 U.S.C. 154(b) by 840 days.

(21) Appl. No.: 12/991,051

(22) PCT Filed: May 27, 2009

(86) PCT No.: PCT/PL2009/000057

§ 371 (c)(1),
(2), (4) Date: Nov. 4, 2010

(87) PCT Pub. No.: WO2009/145651

PCT Pub. Date: Dec. 3, 2009

(65) Prior Publication Data

US 2011/0058924 A1 Mar. 10, 2011

(30) Foreign Application Priority Data

May 29, 2008 (PL) ..... 385300

(51) Int. Cl.
*B65G 47/52* (2006.01)

(52) U.S. Cl.
USPC ..... 414/403; 198/347.1; 414/421

(58) Field of Classification Search
USPC ..... 414/403, 414, 421; 198/347.1; 131/282
See application file for complete search history.

(56) References Cited

U.S. PATENT DOCUMENTS

| | | | | | |
|---|---|---|---|---|---|
| 3,527,369 | A | * | 9/1970 | Bornfleth et al. | 414/414 |
| 3,655,080 | A | * | 4/1972 | Gianese | 414/414 |
| 4,303,366 | A | * | 12/1981 | Hinchcliffe et al. | 414/419 |
| 4,365,703 | A | * | 12/1982 | Hinchcliffe et al. | 414/413 |
| 4,575,301 | A | * | 3/1986 | Lodi et al. | 414/411 |

(Continued)

FOREIGN PATENT DOCUMENTS

| | | | |
|---|---|---|---|
| DE | 1915446 | U | 5/1965 |
| DE | 4118267 | A1 | 12/1992 |

(Continued)

OTHER PUBLICATIONS

International Search Report of PCT/PL2009/000057, mailing date Oct. 26, 2009.

(Continued)

*Primary Examiner* — James Keenan
(74) *Attorney, Agent, or Firm* — Westerman, Hattori, Daniels & Adrian, LLP

(57) ABSTRACT

A device for unloading compartment trays holding rod shaped elements, for use in the tobacco industry, is disclosed. The device includes an inlet conveyor for full trays, an unloading conveyor for unloading rod shaped elements into a throat, a conveyor for out-feeding stacks of rod shaped elements that have been unloaded into the throat, and an outlet conveyor for empty trays. A linear transporter for the trays has a gripping unit that grips the full trays and moves the full trays for unloading into the throat, and a second gripping unit that grips the empty trays and moves the empty trays for cleaning in a cleaning mechanism.

18 Claims, 5 Drawing Sheets

(56) References Cited

U.S. PATENT DOCUMENTS

| | | | | |
|---|---|---|---|---|
| 5,190,428 | A * | 3/1993 | Bryant et al. | 414/403 |
| 6,517,306 | B1 * | 2/2003 | Budny et al. | 414/420 |
| 6,540,061 | B1 | 4/2003 | Focke et al. | |
| 6,860,697 | B2 * | 3/2005 | Bradbury et al. | 414/420 |
| 6,986,632 | B2 * | 1/2006 | Spatafora et al. | 414/421 |
| 7,621,715 | B2 * | 11/2009 | Borderi et al. | 414/810 |
| 8,100,621 | B2 * | 1/2012 | Budny et al. | 414/403 |
| 8,322,511 | B2 * | 12/2012 | Leifheit | 198/347.1 |
| 2003/0113195 | A1 | 6/2003 | Spatafora et al. | |
| 2007/0000215 | A1 | 1/2007 | Borderi et al. | |

FOREIGN PATENT DOCUMENTS

| | | | | | |
|---|---|---|---|---|---|
| EP | 1020126 | A1 | | 7/2000 | |
| EP | 1308101 | A1 | | 5/2003 | |
| EP | 1332683 | A2 | | 8/2003 | |
| EP | 1741352 | A1 | | 1/2007 | |
| GB | 1434421 | A | | 5/1976 | |
| GB | 2072119 | A | * | 9/1981 | 414/403 |
| GB | 2097353 | A | * | 11/1982 | 198/347.1 |
| WO | 2008/020775 | A1 | | 2/2008 | |

OTHER PUBLICATIONS

Written Opinion of PCT/PL2009/000057, mailing date Oct. 26, 2009.

* cited by examiner

DEVICE FOR UNLOADING COMPARTMENT TRAYS, USED IN TOBACCO INDUSTRY, FILLED WITH ROD SHAPED ELEMENTS

FIELD OF THE INVENTION

The subject of the invention is a device for mechanical unloading of compartment trays constituting stores for rod shaped elements, used for transporting elements from a making machine to a receiving machine or for temporary storing elements.

BACKGROUND OF THE INVENTION

In tobacco industry there are often used trays provided for both transporting cigarettes or cigars from a making machine to a packing machine and for transporting and/or temporary storing filter rods in a manufacturing process. For this purpose commonly known one chamber trays are used, which are formed as cubicoids without a top and side wall, and also compartment trays the interior of which is divided into compartments with the aid of vertical inner walls. Delivery of rod shaped elements to operation stations is effected after unloading them in a tray unloader. In case of commonly used one chamber trays, the general principle of operating of a tray unloader is based on turning each delivered one chamber tray so as to make it possible to empty it by gravity or mechanically, whereas rotary or rotary-linear movement can be applied, and full trays are delivered from bottom upwards or in the direction of rotation of the turning unit. During turning of a tray rod shaped elements are held down with a supporting plate, resting against top open side of a tray. After turning and placing the tray in an unloading position, the supporting plate is withdrawn from its bottom holding down position, and rod shaped elements fall out of the tray onto elements placed in a hopper or can be removed mechanically. In tobacco industry there are used numerous unloader constructions operating according to said principle. For instance, from US patent description No. U.S. Pat. No. 3,527,369 it is known a device for unloading one chamber trays, in which a plate supporting rod shaped elements is swing mounted. Delivering a full tray and placing it under a supporting plate is effected with a linear movement of the direction parallel to the axis of rotation of a turning mechanism, whereas the tray is clamped in said mechanism and turned with the supporting plate. After making a turn the tray is lowered so that it is placed in an unloading position as close to previously unloaded elements as possible, where the supporting plate is withdrawn to its retract position. The unloaded tray goes along the way back, whereas it is deposited on an empty tray conveyor disposed below a full tray conveyor. Another U.S. Pat. No. 3,655,080 discloses a device for unloading two one chamber trays at the same time, in which rod shaped elements are held down with a two part supporting plate. Full trays are pushed in pairs from bottom up to the supporting plate assembled in a turning unit, and next, after clamping the trays, they make a turn with the plates. Final phase of displacing trays to an unloading position is a combination of linear and rotary movement, and when the trays are located in the unloading position over previously unloaded elements, a removal of supporting plates follows and rod shaped elements are unloaded. Next, from a description of a European patent No. EP 1 308 101 it is known a device for unloading one chamber trays filled with rod shaped elements, in particular cigars, in which a tray filled with cigars is positioned, with a special gripping unit, with top opening of the tray covered momentarily with a guard, onto a movable supporting surface provided with a movable throat of width smaller than the width of the top opening, but bigger than the diameter of a single cigar. The movable supporting surface constitutes a base of the enclosure of the width slightly bigger than total width of two trays, constituting an inlet and outlet station, and below the supporting surface there is a receiving conveyor. A tray passed to the inlet station, after removing a cover, is unloaded through the throat, and cigars fall onto the conveyor and are delivered to a packing machine. Due to suitable controlling of the drives of rollers guiding a driving belt the possibility of multiple displacement of the throat to and fro is obtained so that the throat is always situated within the unloaded tray, which is finally deposited in the outlet station. The device is so constructed that the supporting surface and a tray displace with a speed twice as much as the speed of the carriage of the throat so that the throat permanently changes its position with relation to the opening of the tray. After completing unloading an empty tray is removed by said gripping unit onto the outlet conveyor parallel to the inlet conveyor of full trays. In description of another European patent No. EP 1,332,683 it is presented a device for unloading one chamber trays provided with a full tray conveyor passing trays under a supporting plate of a turning mechanism, with an empty tray conveyor, situated below, of opposite direction of movement, on which trays are placed after unloading. The invention solves a method of controlling the speed of unloading trays depending on filling of a receiving channel. Another method and a device for successive unloading one chamber trays filled in particular with cigarettes has been presented in description of U.S. Pat. No. 6,517,306. According to the invention a full tray disposed in a frame is transported to an unloading station, then the tray is displaced back to the delivery station, whereas a subsequent tray, while passing it to the frame, removes an empty tray situated in the frame directly or indirectly. Because of practical reasons, in order to obtain a uniform mass flow of rod shaped elements in form of stack of a certain height, which can be delivered to a hopper of a packing machine by means of a conveyor, intermediate stores are used, having usually form of a tray, the interior of which is divided into compartments with the aid of vertical inner walls. This type of a device has been presented in description of U.S. Pat. No. 4,365,703 disclosing a system of conveyors for rod shaped elements, where elements passed from a making machine are loaded from top to a store consisting of many trays comprising vertical compartments, and at a proper moment compartments are successively emptied onto a receiving conveyor, which delivers elements to a packing machine, whereas the emptying is effected in the same vertical compartment in which filling the intermediate store takes place after opening a plate closing the bottom of a respective compartment, and loading and emptying of consecutive trays of the store is possible due to suitable displacing them laterally with relation to a receiving conveyor. Still another solution of an intermediate store of compartment construction has been presented in a British patent description No. GB 1.434.421. An intermediate store is located between a machine delivering rod shaped elements and a hopper of a packing machine, whereas in case of disturbance in receiving elements they are passed to further compartments of the store. In case of disturbance in delivering elements, compartments are unloaded in a reverse sequence onto a conveyor delivering elements to the hopper. Moreover the invention solves construction details enabling proper operating of the store. From international publication No. WO 2008/020775 it is known a method of unloading one chamber trays, where rod shaped elements are passed by gravity from a tray simultaneously to many compartments, of an intermediate store, separated from each other with vertical division walls, the store constituting a volume equivalence of a tray, whereas elements are passed onto a movable conveyor disposed beneath. Emptying of consecutive compartments is effected independently on each other through a throat formed in the base of the store, whereas both the intermediate store and the base with the throat make independent reciprocating movements along the receiving conveyor so as to enable positioning consecutive compartments of the store directly over the throat, and the sequence of emptying the compartments is backward to the direction of receiving elements on the conveyor. Said elements are placed on the conveyor by means of a chute fixed to the throat, whereas the throat, the area of which corresponds to the area of a horizontal cross-section of a compartment of the intermediate store, collects elements each time from one consecutive compartment, and complete emptying of a compartment is controlled with a sensor. The width of compartments being emptied corresponds to the height of the stack of mass flow of rod shaped elements on the conveyor. In order to reduce deformation of rod shaped elements during transporting and handling, there are also used compartment trays where each compartment may be emptied independently on others, and as a result within compartments elements are neither displaced horizontally nor positioned askew which occurs in case of typical one chamber trays. Such a tray or a device for unloading it into a hopper of a packing machine has been presented in description of German utility model DE 1.915.446. Inner walls parallel to the side walls of the tray divide it into compartments of cross section corresponding to the cross section of a feeding channel of a packing machine, and the bottom of the tray is constituted by a movable uniform supporting plate. Full trays are disposed successively on an inlet conveyor, and a parallel outlet converyor is used for removing empty trays. Between conveyors there is an immovable guide perpendicular to said conveyors, provided with a throat situated between conveyors and the feeding channel of the packing machine. Above the guide, at a distance corresponding to the height of the tray there is disposed a movable chain of closed loop provided with two drivers, whereas the distance between the drivers is slightly bigger than the length of the tray. The supporting plate has, on its end protruding off the tray, a catch cooperating with a seat in the guide. Unloading of each consecutive tray is effected so that after placing it on a lateral guide from an inlet conveyor the catch of the supporting plate engages with the seat, and the driver of the chain pushes the tray against its side wall so that above the throat there is exposed the bottom of each consecutive compartment of the tray, and rod shaped elements fall by gravity into the channel of a packing machine. The tray being guided with a proper speed enables emptying in succession all the compartments, and then a next full tray is fed from the inlet conveyor, and the empty tray is placed on the outlet conveyor.

SUMMARY OF THE INVENTION

The object of the invention is construction of a device for unloading compartment trays, used in tobacco industry, filled with rod shaped elements, having an inlet conveyor for full trays and an outlet conveyor for empty trays arranged parallel in one plane, and having a turning unit, for full trays, disposed in the zone of the end of conveyor for full trays, provided with a plate supporting rod shaped elements in a tray, and having an unloading conveyor and a conveyor for out-feeding a stack of rod shaped elements unloaded into the throat. According to the invention the device is provided with a linear transporter, for full and empty trays, situated in a plane perpendicular to the plane of an inlet conveyor and outlet conveyor, above a turning unit for full trays and a turning unit for empty trays. The linear transporter is provided with a gripping unit, arranged movably, for full trays, and a gripping unit for empty trays. Said unloading conveyor for rod shaped elements is situated below the linear transporter, in the zone of operating of the gripping unit for full trays so that its end is situated at the inlet of an immovable throat, whereas the distance between the gripping unit for full trays and the unloading conveyor corresponds to the height of the tray. The turning unit for full trays is provided with a plate, for supporting rod shaped elements, fixed to a main plate of the turning unit, consisting of plurality of elements, the number of which corresponds to the number of compartments of a compartment tray, and the distance between elements corresponds to the thickness of inner walls of the tray. Said turning unit for full trays is provided with a movable platform mounted in lower part of the turning unit, below the inlet conveyor and movable over a plane perpendicular to the plane of the inlet conveyor. Moreover the device has an alignment unit for full trays mounted on the inlet conveyor before the turning unit. In the zone of the origin of the outlet conveyor there is situated a separate turning unit for empty trays, which is also provided with a movable platform, mounted in lower part of the turning unit below the outlet conveyor and movable over a plane perpendicular to the plane of the outlet conveyor. Said linear transporter is composed of a guide, situated along the transporter, on which there are disposed, in one plane, two separate gripping units, whereas each gripping unit has a form of a carriage, suspended on the guide, provided with two grippers, driven respectively with a belt and making reciprocating movements, whereas the carriage with grippers of the gripping unit for full trays is disposed in the zone of the end of the inlet conveyor, and the carriage with grippers of the gripping unit for empty trays is disposed in the zone of the origin of the outlet conveyor. During unloading of a full tray the gripping unit moves stepwise, each time by the distance equal to the width of the compartment, and an unloading conveyor also moves stepwise in synchronism with the full tray carried in the gripping unit, each time by the distance equal to the width of the compartment. Walls of the throat, perpendicular to rod shaped elements, are movable and constitute an alignment device for elements, whereas the width of the throat corresponds to the width of compartments of the tray. Below the throat there is disposed a movable support of top surface dimensions corresponding to the dimensions of the inlet of the throat, whereas during continuous operating of the device the top surface of the support is situated in the plane of an out-feeding conveyor. A vertical wall of the throat between an unloading conveyor and the out-feeding conveyor is provided with a swing valve plate. At the moment before the starting of unloading of the first full tray the surface of the support is situated in the plane of the unloading conveyor, with the valve plate being lowered and the out-feeding conveyor being empty. In the zone of the origin of the outlet conveyor, below the gripping unit for empty trays, there is disposed a mechanism for cleaning compartments of an empty tray. Said mechanism is provided with brushes, the number of which corresponds to the number of compartments of the tray, making reciprocating movements in a plane perpendicular to the plane of the outlet conveyor, whereas the brushes are rotary assembled in the mechanism. Thanks to applying a simple system of a movable support and a valve plate in the throat, the process of emptying of the first tray in the device is commenced automatically, without additional activity of an operator. In course of operating of the device the cycle of unloading of a consecutive tray is started at the moment of finishing of unloading of a preceding tray, and the time needed for passing a full tray and collecting of an empty tray does not break down flowing of rod shaped elements into the throat. As a result there is no necessity of using a buffer in form of a certain number of elements gathered for the time of tray changing. Rod shaped elements delivered to the throat fall onto the mass flow in the throat from a minimum height, and they are aligned in the throat so they do not have a possibility to position askew. Cleaning applied for each compartment of an empty tray, for removing residues of filters and dirt ensures proper next filling, which reduces failures in the process.

BRIEF DESCRIPTION OF THE DRAWINGS

The object of the invention has been shown in an example of embodiment in the drawing, in which.

DETAILED DESCRIPTION OF THE INVENTION

Figure 1:
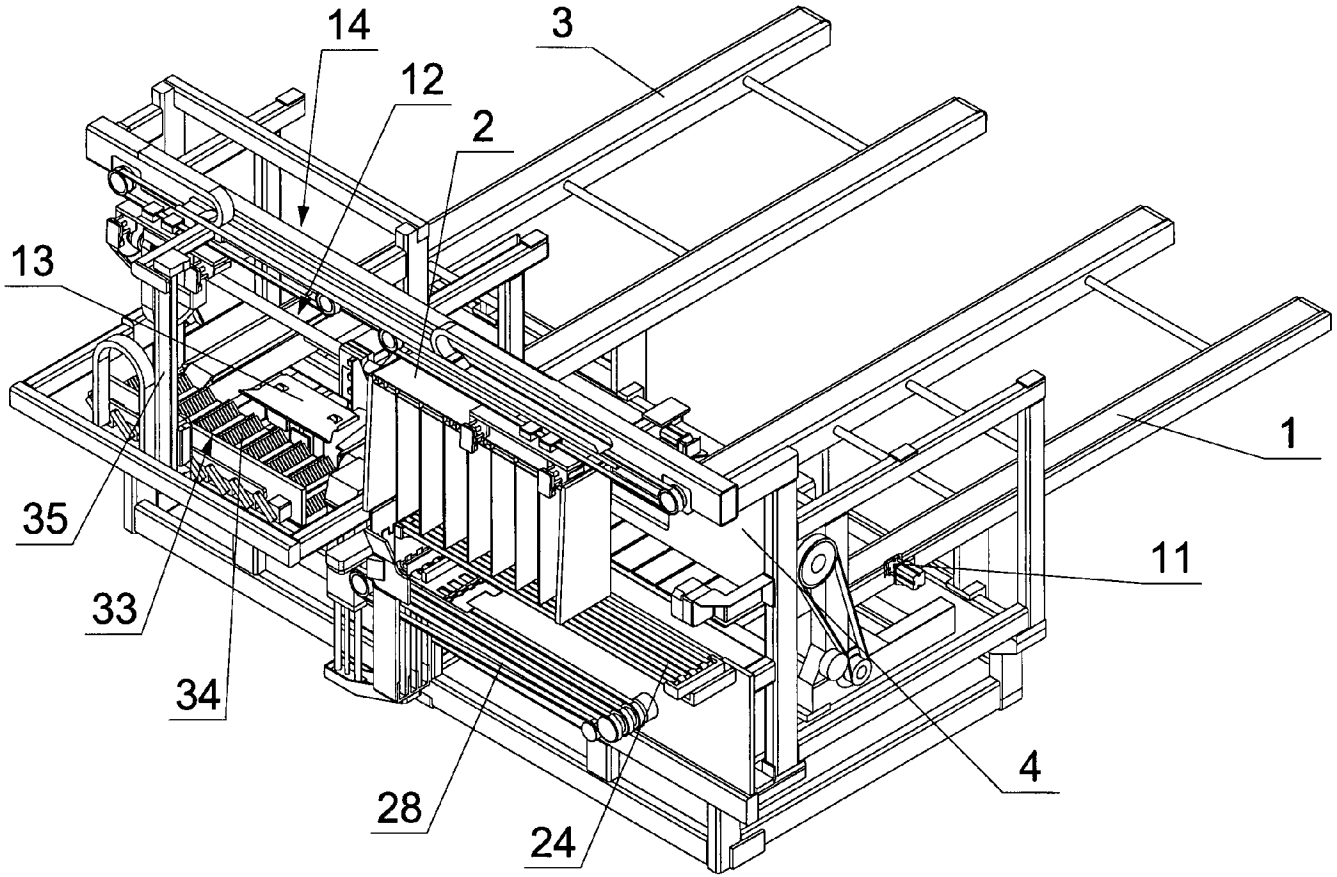
FIG. 1 presents a device in a perspective view from the side of a linear transporter for trays, FIG. 2—a turning unit for full trays in a perspective view from the side as in FIG. 1, but in bigger scale, FIG. 3—enlarged fragment of the device of FIG. 1 showing a unit for collecting rod shaped elements unloaded from a full tray, FIG. 3*a*—fragment of the unit of FIG. 3 showing a throat at the moment of starting emptying of the first full tray, FIG. 3*b*—fragment of the unit of FIG. 3 showing the throat during constant operating of the device, FIG. 4—fragment of the device presented schematically in the view from the side of a linear transporter at the moment of passing the first full tray for unloading, FIG. 5—the device of FIG. 4 at the moment of finishing of unloading of the first tray and passing a consecutive full tray for unloading, FIG. 6—the device of FIG. 4 during unloading of a consecutive tray and placing the preceding empty tray back after unloading, and FIG. 7—the device of FIG. 4 after unloading the last tray.
Figure 2:
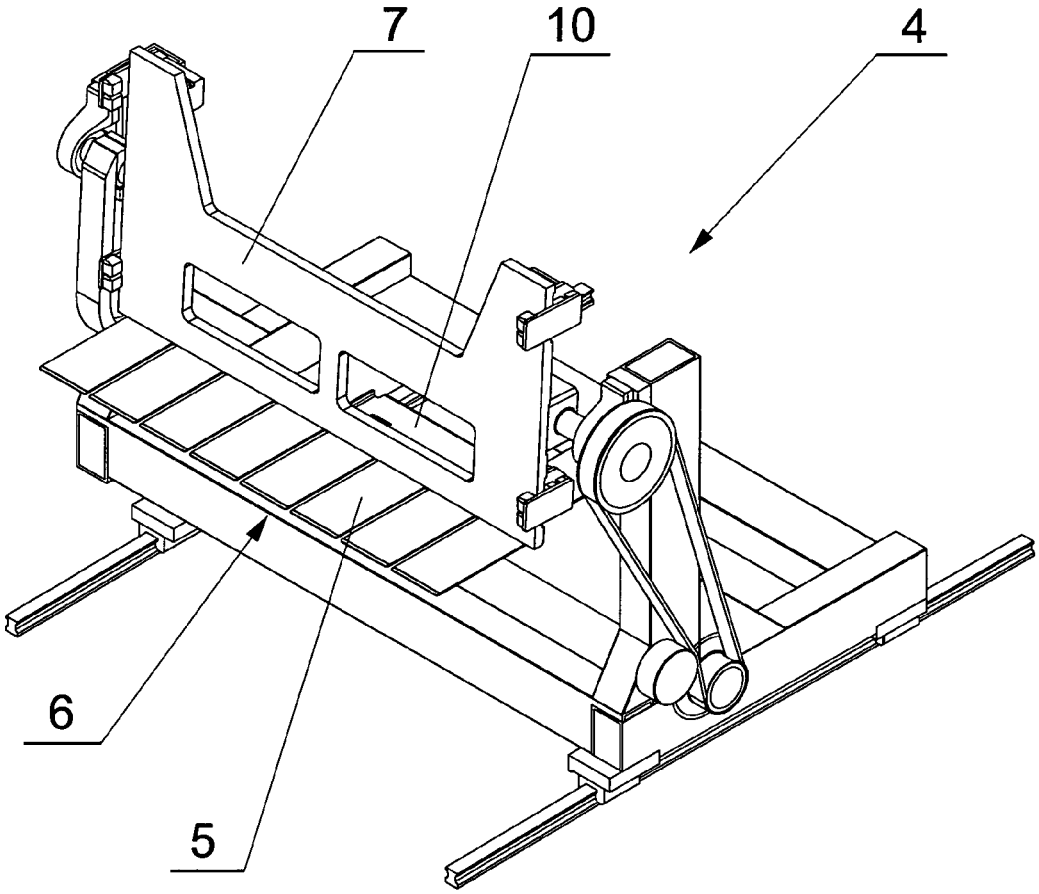
Figure 3A:
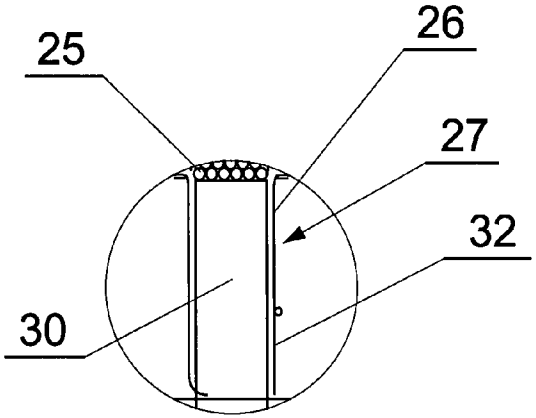
Figure 3B:
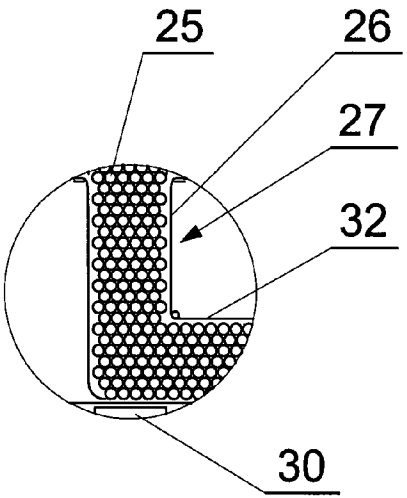
Figure 3:
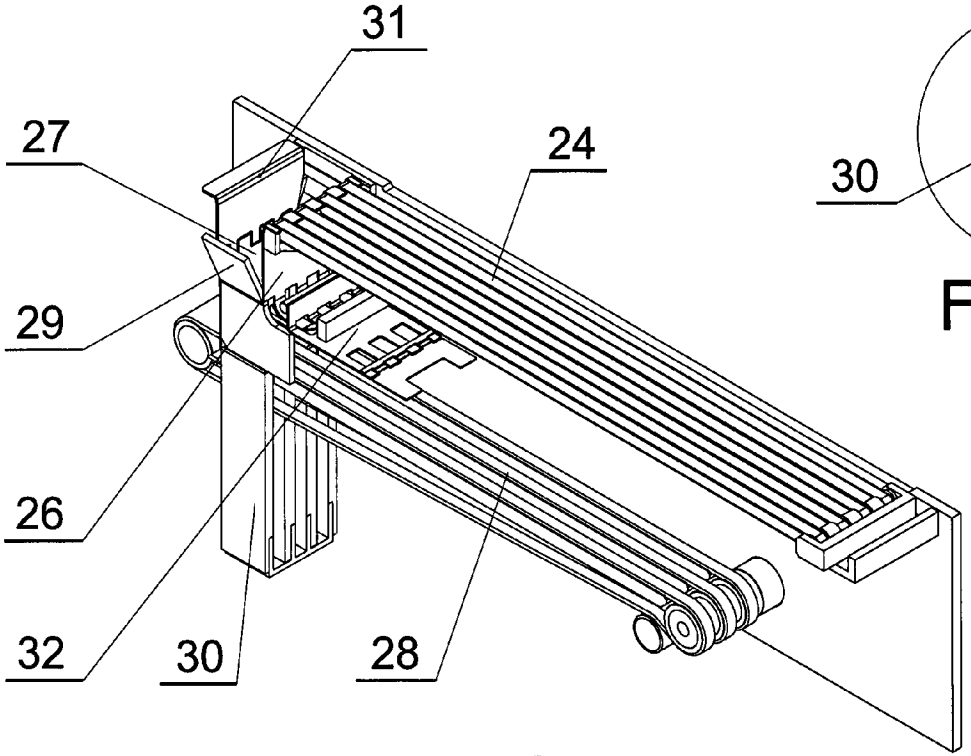
Figure 4:
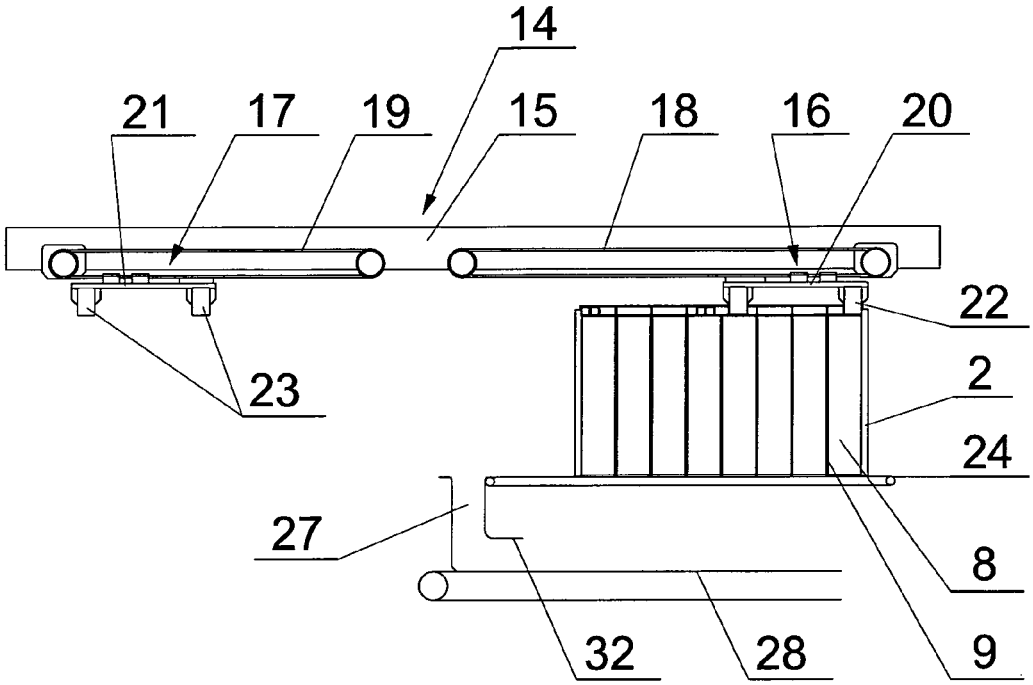
Figure 5:
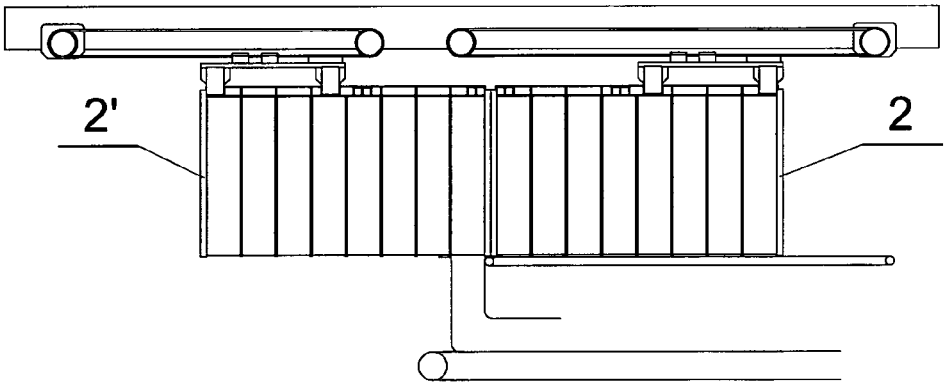
Figure 6:
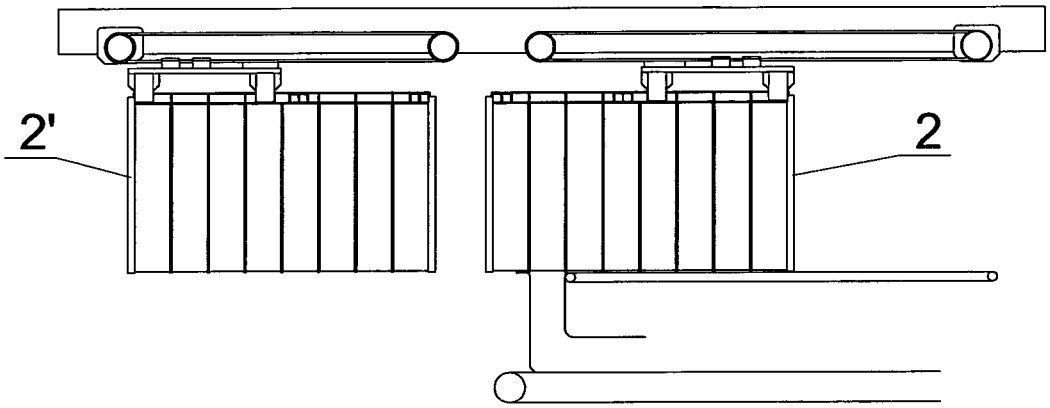
Figure 7:
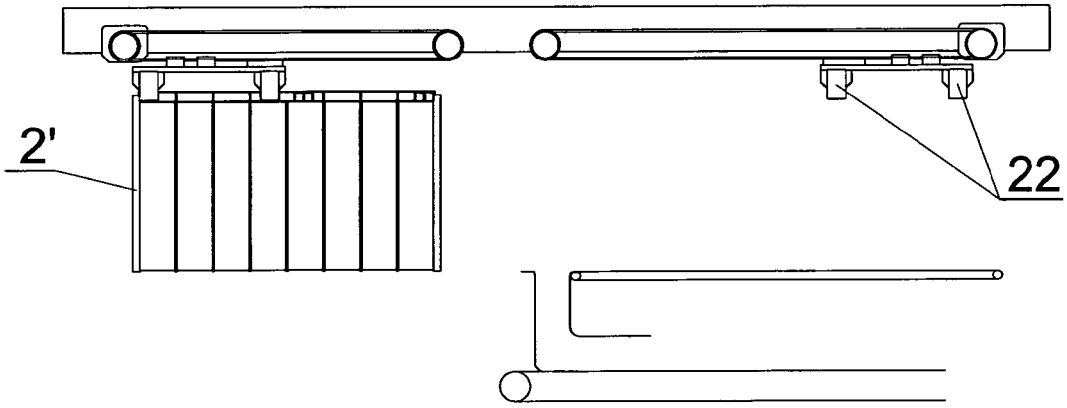

The device has an inlet conveyor 1 for full trays 2 and an outlet conveyor 3 for empty trays 2' arranged parallel in one plane. In the zone of the end of the inlet conveyor 1 there is disposed a turning unit 4 for full trays 2, provided with a supporting plate 6, composed of elements 5, fixed to a plate 7 of the turning unit 4. The number of elements 5 is equal to the number of compartments 8 of the full tray 2, and the distance between elements 5 corresponds to the thickness of vertical inner walls 9, which divide the full tray 2 into compartments 8. The turning unit 4 for full trays 2 is provided with a movable platform 10, mounted in lower part of the turning unit 4 below the inlet conveyor 1, and movable over a plane perpendicular to the plane of the inlet conveyor 1. On the inlet conveyor 1, before the turning unit 4, there is mounted an alignment unit 11 for aligning full trays 2 on the inlet conveyor 1. In the zone of the origin of the conveyor 3 there is a turning unit 12 for empty trays 2' operating independently of the turning unit 4 for full trays 2. The turning unit 12 is provided with a movable platform 13, mounted in lower part of the turning unit 12 below the outlet conveyor 3, and movable over a plane perpendicular to the plane of the outlet conveyor 3.

The device has a linear transporter 14 situated in a plane perpendicular to the plane of the inlet conveyor 1 and outlet conveyor 3 above the turning unit 4 for full trays 2 and the turning unit 12 for empty trays 2'. The linear transporter 14 consists of a guide 15, on which there are mounted, in one plane, gripping units 16 and 17 driven respectively with belts 18 or 19. Each unit 16 and 17 has a form of a carriage 20 or 21, suspended on the guide 15, provided with two grippers 22 or 23. The gripping unit 16 for full trays 2 in form of the carriage 20 with grippers 22 makes reciprocating movements in the zone of the inlet conveyor 1 driven with the belt 18, and the gripping unit 17 for empty trays 2' in form of the carriage 21 with grippers 23 makes reciprocating movements in the zone of the outlet conveyor 3 driven with the belt 19. During unloading of a full tray 2, the gripping unit 16 displaces stepwise, each time by the distance equal to the width of the compartment 8.

Below the linear transporter 14, in the zone of operating of the gripping unit 16 for full trays 2, there is located an unloading conveyor 24, arranged parallel to the transporter 14, for rod shaped elements 25, whereas the distance between grippers 22 of the unit 16 and the conveyor 24 corresponds to the height of the full tray 2. The end of the unloading conveyor 24 is in close vicinity of a vertical wall 26 of a throat 27, through which rod shaped elements 25 fall onto an out-feeding conveyor 28 located beneath the unloading conveyor 24, the conveyors move in opposite directions. During unloading of a full tray 2, the unloading conveyor 24 displaces stepwise in synchronism with the full tray 2 carried by grippers 22 of the carriage 20, each time by the distance equal to the width of the compartment 8. Walls of the throat 27, perpendicular to rod shaped elements 25, are movable and constitute an alignment unit 29.

Below the throat 27 there is slidably mounted a movable support 30 of top surface dimensions corresponding to the dimensions of the inlet of the throat 27, and moreover in the plane of the inlet of the throat 27 there is mounted an optical sensor 31 for indicating filling of the throat 27 with rod shaped elements 25. A vertical wall 26 of the throat 27 between the unloading conveyor 24 and the out-feeding conveyor 28 is provided with a swing valve plate 32. At the moment before starting unloading of the first full tray 2 the surface of a movable support 30 is located in the plane of the unloading conveyor 24, with the swing valve plate 32 being lowered and the out-feeding conveyor 28 being empty, whereas during constant operating of the device the surface of the support 30 is located in the plane of the out-feeding conveyor 28.

In the zone of the origin of the outlet conveyor 3, below the gripping unit 17 with grippers 23 for empty trays 2', there is disposed a mechanism 33 for cleaning compartments 8 of an empty tray 2'. The mechanism 33 has brushes 34, the number of which corresponds to the number of compartments 8 of the empty tray 2', which make reciprocating movements in the plane perpendicular to the plane of the outlet conveyor 3 by means of a guiding column 35. The brushes 34 are rotary arranged in the mechanism 33.

Function Description of the Invention

The functioning of the device is described hereinafter. After verifying the code of a full tray 2 situated on the inlet conveyor 1, the full tray 2 becomes aligned by the alignment unit 11, and the turning unit 4 displaces towards the full tray 2 till its movable platform 10 is located below the full tray 2. Then the movable platform 10 raises and intercepts the tray 2 from the inlet conveyor 1 and the turning unit with the full tray 2 displaces into an intermediate position, where the main plate 7 and the supporting plate 6 are rotated by 180° so that the elements 5 enter the compartments 8 of the full tray 2 and are in contact with rod shaped elements 25, and the full tray 2 becomes clamped in the turning unit 4 by grippers located on the main plate 7, whereas the platform 10 retracts to its lower position. Next, the turning unit 4 with the full tray 2 displaces to the unloading position, where the full tray 2 is rotated by 180° in the opposite direction, and the full tray 2 becomes gripped by the grippers 22 mounted on the carriage 20 of the gripping unit 16, whereas the grippers located on the main plate 7 become released. Then, the turning unit 4 and the supporting plate 6 retract to the intermediate position, and rod shaped elements 25 in compartments 8 of the full tray 2 are rested against the unloading conveyor 24.

Next, the carriage 20 and the full tray 2 move in synchronism with the unloading conveyor 24 so that above the throat 27 there is always only one consecutive compartment 8. Rod shaped elements 25 fall by gravity onto the out-feeding conveyor 28 situated beneath and are farther transferred in stack formation under the swing valve plate 32 positioned horizontally, whereas in the throat 27 rod shaped elements 25 are aligned by an alignment device 29. For the unloading conveyor 24 moves in synchronism with the full tray 2, rod shaped elements 25 in the lowermost layer are not rolled. The full tray 2 is displaced to the position of emptying the next compartment 8 after receiving a permission signal from the optical sensor 31 located by the inlet of the throat 27 close under the unloading conveyor 24. During emptying of the last compartment 8, the full tray 2 becomes gripped by the grippers 23 mounted on the carriage 21 of the gripping unit 17, which in the meantime has been displaced along the guide 15 over the tray 2. After the tray 2 has been gripped, the released grippers 22 and the carriage 20 displace along the guide 15 to a start position, and the turning unit 4 repeats the above described process of taking of a consecutive full tray 2, which becomes placed on the linear transporter 14 so that it presses against the empty tray 2' the process of emptying of which is just being finished.

The empty tray 2' is displaced with the carriage 21 over the turning unit 12, where cleaning of the compartments 8 of the empty tray 2' takes place with the brushes 34 guided along the vertical walls 9 by the mechanism 33, whereas after reaching the bottom of the empty tray 2' the brushes 34 make a rotation by 90° and move down backwards. The empty tray 2' becomes intercepted by clamps on the turning unit 12 and placed on the outlet conveyor 3 due the downward displacement of the platform 13 and next it is uncoded.

In case of unloading the first full tray 2 delivered to the device, before setting the first compartment 8 over the throat 27, the surface of the support 30 is located in the throat 27 directly under the optical sensor 31, and the swing valve plate 32 is lowered and thus constituting a continuation of the vertical wall 26. After placing a compartment 8 over the throat 27, the support 30 is lowered at a speed corresponding to the speed of mass flow of rod shaped elements 25 till the plane of out-feeding conveyor 28 is reached, whereas in the meantime the swing valve plate 32 is lifted successively to create a stack of rod shaped elements 25 on the conveyor 28.

List of Denotations

1—inlet conveyor
2—full tray
2'—empty tray
3—outlet conveyor
4—turning unit for full trays
5—elements of supporting plate
6—supporting plate
7—main plate of turning unit
8—tray compartments
9—inner vertical walls of tray
10—movable platform of full tray turning unit
11—full tray alignment unit
12—empty tray turning unit
13—movable platform of empty tray turning unit
14—linear transporter
15—guide
16—gripping unit for full trays
17—gripping unit for empty trays
18—belt of full tray gripping unit
19—belt of empty tray gripping unit
20—carriage of gripping unit for full trays
21—carriage of gripping unit for empty trays
22—grippers for full trays
23—grippers for empty trays
24—unloading conveyor
25—rod shaped elements
26—vertical wall of throat
27—throat
28—out-feeding conveyor
29—alignment device for rod shaped elements in throat
30—movable support in throat
31—optical sensor in throat
32—valve plate in vertical wall of throat
33—cleaning mechanism
34—brushes of cleaning mechanism
35—guiding column for brushes

The invention claimed is:

1. A device for unloading a compartment tray comprising:

an inlet conveyor which delivers a full compartment tray to a first turning unit that is disposed at a terminal portion of the inlet conveyor, the full compartment tray having been filled with rod shaped elements;

an outlet conveyor which delivers an empty compartment tray from a second turning unit that is disposed at a front portion of the outlet conveyor, the outlet conveyor being disposed at a same height as the inlet conveyor;

an unloading conveyor which unloads the rod shaped elements into an immovable throat, an end portion of the unloading conveyor abutting an inlet of the immovable throat;

an out-feeding conveyor which receives and outfeeds the rod shaped elements that have been unloaded into the immovable throat, the out-feeding conveyor being disposed below the unloading conveyor and being connected to the unloading conveyor via the immovable throat; and a linear transporter that is mounted above the first turning unit and the second turning unit, wherein the linear transporter comprises a first gripping unit which is disposed above the unloading conveyor and which moves the full compartment tray, and a second gripping unit which moves the empty compartment tray, and wherein a distance between the first gripping unit and the unloading conveyor is substantially the same as a height of the compartment tray.

2. The device according to claim 1, wherein the first turning unit comprises a main plate, and a supporting plate which is connected to the main plate and which comprises a plurality of supporting elements, wherein a number of the plurality of supporting elements is equal to a number of compartments in the compartment tray, and wherein a distance between each of the plurality of supporting elements is substantially the same as a thickness of an inner wall of the compartment tray.

3. The device according to claim 2, wherein the first turning unit further comprises a movable platform mounted in a lower part of the first turning unit, the lower part of the first turning unit being below the inlet conveyor, and wherein the movable platform moves in a plane perpendicular to the inlet conveyor.

4. The device according to claim 3, wherein the inlet conveyor comprises an alignment unit which aligns the full compartment and which is disposed on the inlet conveyor at a position before the first turning unit.

5. The device according to claim 1, wherein the inlet conveyor comprises an alignment unit which aligns the full compartment tray, the alignment unit being disposed on the inlet conveyor at a position before the first turning unit.

6. The device according to claim 1, wherein the second turning unit comprises a movable platform mounted in a lower part of the second turning unit, the lower part of the second turning unit being below the outlet conveyor, and wherein the movable platform moves in a plane perpendicular to the outlet conveyor.

7. The device according to claim 1, wherein the linear transporter further comprises a guide, wherein the first gripping unit and the second gripping unit are mounted on the guide wherein each of the first gripping unit and the second gripping unit comprises a carriage, two grippers disposed on opposite ends of the carriage, and a driving belt, and wherein each of the first gripping unit and the second gripping unit makes reciprocating movement.

8. The device according to claim 7, wherein during unloading of the full compartment tray, the first gripping unit moves stepwise, a distance of each step of the stepwise movement being equal to a width of a compartment of the compartment tray.

9. The device according to claim 8, wherein during unloading of the full compartment tray, the unloading conveyor is configured to move stepwise in synchronism with the first gripping unit, a distance of each step of the stepwise movement being equal to the width of the compartment of the full compartment tray.

10. The device according to claim 1, wherein during unloading of the full compartment tray, the unloading conveyor is configured to move stepwise in synchronism with the first gripping unit, a distance of each step of the stepwise movement being equal to a width of a compartment of the compartment tray.

11. The device according to claim 1, wherein the immovable throat comprises an alignment device which aligns the rod shaped elements, wherein the alignment device comprises a movable portion of a wall of the immovable throat, and wherein a width of the immovable throat is substantially the same as a width of a compartment of the compartment tray.

12. The device according to claim 11, wherein a movable support is slidably mounted in the immovable throat, wherein a surface area of a top surface of the movable support is substantially the same as a surface area of the inlet of the immovable throat, and wherein during unloading of the full compartment tray, the movable support is configured to move the top surface of the movable support downward to a same height as the out-feeding conveyor.

13. The device according to claim 12, wherein a vertical wall of the immovable throat between the unloading conveyor and the out-feeding conveyor comprises a swing valve plate.

14. The device according to claim 13, wherein before the rod shaped elements in a first compartment of a first full compartment tray are unloaded, the swing valve plate is lowered and is contiguous with the vertical wall of the immovable throat, wherein the movable support is configured to move the top surface of the movable support to a same height as the unloading conveyor, and wherein the out-feeding conveyor is empty.

15. The device according to claim 12, wherein before the rod shaped elements in a first compartment of a first full compartment tray are unloaded, a swing valve plate is lowered and is contiguous with a vertical wall of the immovable throat, wherein the movable support is configured to move the top surface of the movable support to a same height as the unloading conveyor, and wherein the out-feeding conveyor is empty.

16. The device according to claim 1, further comprising a cleaning mechanism which cleans a compartment of the empty compartment tray, wherein the cleaning mechanism is disposed at the front portion of the outlet conveyor, and wherein the cleaning mechanism is disposed below the second gripping unit.

17. The device according to claim 16, wherein the cleaning mechanism comprises a plurality of brushes, wherein the plurality of brushes are adapted to make reciprocating movement in a plane perpendicular to the outlet conveyor, and wherein a number of the plurality of brushes is equal to a number of compartments in the compartment tray.

18. The device according to claim 17, wherein the plurality of the brushes are rotatable in the cleaning mechanism.

* * * * *